United States Patent [19]

Leo

[11] 4,311,021

[45] Jan. 19, 1982

[54] SCREW COMPRESSOR-EXPANDER CRYOGENIC SYSTEM WITH MIST LUBRICATION

[75] Inventor: Bruno S. Leo, Santa Monica, Calif.

[73] Assignee: Hughes Aircraft Company, Culver City, Calif.

[21] Appl. No.: 102,305

[22] Filed: Dec. 10, 1979

Related U.S. Application Data

[63] Continuation-in-part of Ser. No. 894,677, Apr. 10, 1978, abandoned.

[51] Int. Cl.[3] ..... F25D 9/00

[52] U.S. Cl. ..... 62/402; 62/468; 418/86

[58] Field of Search ..... 62/505, 402, 6, 468, 62/469, 84; 418/9, 200, 201, 86

[56] References Cited

U.S. PATENT DOCUMENTS

| | | | |
|---|---|---|---|
| 1,732,039 | 10/1929 | Cuthbert | 62/84 |
| 3,405,604 | 10/1968 | Lysholm | 418/86 |
| 3,751,673 | 8/1973 | Sprankle | 418/201 |
| 3,795,117 | 3/1974 | Moody, Jr. et al. | 62/505 |
| 3,902,827 | 9/1975 | Schibbye | 418/201 |
| 3,910,731 | 10/1975 | Perrson et al. | 418/201 |
| 3,956,904 | 5/1976 | Edwards | 62/402 |

FOREIGN PATENT DOCUMENTS 609405 1/1935 Fed. Rep. of Germany .

*Primary Examiner*—Ronald C. Capossela
*Attorney, Agent, or Firm*—Allen A. Dicke, Jr.; W. H. MacAllister

[57] ABSTRACT

Screw compressor 32 and screw expander 70 are connected into a refrigeration system. The system includes a mist lubrication system which drives oil particles suspended in flowing gas past the compressor and expander bearings for long life operation.

6 Claims, 3 Drawing Figures

SCREW COMPRESSOR-EXPANDER CRYOGENIC SYSTEM WITH MIST LUBRICATION

CROSS-REFERENCE TO RELATED APPLICATIONS

This application is a continuation-in-part of patent application Ser. No. 894,677 filed Apr. 10, 1978, now abandoned, by Bruno S. Leo for "Screw Compressor-Expander Cryogenic System", the entire disclosure which is incorporated herein by this reference. A continuation application thereof was filed on June 12, 1980 and that application was abandoned on June 12, 1980. The continuation application received Ser. No. 158,764.

BACKGROUND OF THE INVENTION

This invention is directed to a cryogenic system where both the compressor and expander, which operate with the cryogenic refrigerant fluid in the system, are rotary screw-type machinery of the Lysholm type with the expander being coupled to the drive system with a mist lubrication system for the bearings and any timing gears to provide long life.

Lysholm built an early prototype of the rotary screw compressor in 1934. Some of his development work was described in the *Proceedings of the Institution of Mechanical Engineers,* Vol. 150, No. 1, Pages 11–16 and 4 plates 1943. One of the main features of this screw compressor is the fact that it can run without oil or other lubricant in the compression chamber. No oil is necessary in the compression chamber because the rotors can be designed so they do not contact each other or the casing. The only mechanical contact is in the bearings and in the timing gears (if any) which can be located on the outside of the gas containing casing and away from the refrigerant gas flow stream. The Lysholm type rotary screw compressor has two rotors with intermeshing lobes. Within the intermesh of the lobes and housing, the compression takes place. Two helical rotors comprise the working parts of the screw compressor. The male rotor generally has four lobes and rotates 50 percent faster than the female rotor which has six flutes between which are grooves in which the lobes interengage. Other ratios of lobes to flutes are also used. The gas is compressed in the spaces between the housing, the lobes and the grooves. The lobes and the grooves are helical so that the space appears to move progressively toward the outlet end of the housing, and the space becomes progressively smaller along the length of the rotors as the rotors rotate. Thus, gas taken in the inlet port at the suction end is compressed in the space as the rotors turn and the gas is delivered at higher pressure from the outlet port at the delivery end of the housing. The inlet and outlet ports are automatically covered and uncovered by the shaped ends of the rotors as they turn.

There has been considerable development work done on the improvement of such screw compressors. Most of the patents are owned by Svenska Rotor Maskiner which devoted the pioneer effort in this art and appears to hold most of the patents. The company is located in Nacka, Sweden.

Nilsson, U.S. Pat. No. 3,245,612 and Schibbye, U.S. Pat. Nos. 3,283,996 and 3,423,017 are particularly directed to the shapes of the lands and the grooves in the rotors, but show the porting and general organization of the rotary screw compressor to show how compression and expansion are achieved in such a structure. Furthermore, this type of screw compressor is illustrated as being the compressor in refrigerator systems in U.S. Pat. Nos. 3,432,089; 3,811,291; 3,848,422 and 3,945,216. While the use of screw compressors has been recognized for refrigerator compressor service, the use of such devices as expanders for such service has not been recognized. Furthermore, it has not been previously recognized that screw compressors and expanders in the same refrigerator can efficiently run at about the same speed so that they can be coupled directly or through gearing, for speed control of the expander and for power feedback from the expander. In the refrigeration arts, it is known that with some gases and conditions, it is necessary to extract work during expansion to produce refrigeration, with some refrigerant gases within some of their operating temperature ranges. In the past, piston expanders have been used, usually in smaller refrigerators, and turboexpanders have been used, usually in large refrigerators. While the work output of such expanders is not significant in terms of total refrigerator input power, speed control of the expander is necessary. Such speed control has been difficult where the turboexpander runs at very high speed. It is part of this invention that the employment of an expander coupled to and running with the compressor is feasible when screw-type equipment is used for refrigerant gas compression and expansion.

In order to supply economical refrigeration associated with long and trouble free life, a design of minimum complexity, is necessary. The structure of this invention provides a refrigerator which is of low weight per unit of refrigeration, and is especially designed so that in the small sizes for which this refrigeration system is most suitable, the structure is of simplified mechanical design. Thus, such a refrigeration system can be used to cool devices for long maintenance free life and can be employed in locations where total weight and input power should be minimized.

SUMMARY OF THE INVENTION

In order to aid in the understanding of this invention, it can be stated in essentially summary form that it is directed to a screw compressor-expander cryogenic refrigerator system wherein a mist lubrication system is provided for the bearings of the compressor and expander as well as the drive motor, with the system divided into two loops, each loop being connected through bearings subjected to about the same ambient pressure.

It is thus an object of this invention to provide a screw compressor-expander cryogenic system wherein Lysholm-type gas handling equipment is used for compression and expansion of the gas to produce refrigeration. It is another object of this invention to provide a refrigerator wherein a long trouble-free life is achieved. It is a further object to provide a screw compressor-expander cryogenic refrigerator system wherein the expander runs at the same relative rotative rate as the compressor to permit coupling between the expander and compressor for speed control of the expander and feedback of work from the expander to the compressor.

It is another object to provide a screw compressor-expander cryogenic system with lubrication for the system bearings to enhance life. It is a further object to provide a lubrication system which is substantially independent of gravity so that the bearings in the equipment are lubricated independent of local gravity conditions.

It is a further object to provide a screw compressor-expander cryogenic system wherein heat exchange in the system is through a regenerator to enhance system efficiency, together with suitable valving to provide for reversing regenerator fluid flow in the system. It is a further object to provide a screw compressor-expander cryogenic refrigerator system wherein the two rotors in the compressor chamber are coupled together through a hydrodynamic gas film so that the driven rotor rotates without mechanical contact against the driving rotor, and in the expander chamber, the rotors are not geared together but are separated by hydrodynamic gas action to reduce wear on the running parts of the refrigerator system and this maintain a long life.

It is another object to provide a screw compressor-expander cryogenic refrigerator system wherein the employment of a screw-type compressor and a screw-type expander permits the production of refrigeration at an increased value of unit of refrigeration per unit of weight so that the system can be employed in locations where weight is critical. It is a further object to provide a cryogenic refrigerator system which employs a screw-type compressor and a screw-type expander wherein more refrigeration is produced per unit of input power to permit use of the refrigerator system in locations where power must be conserved.

Other objects and advantages of the this invention will become apparent from a study of the following portion of the specification, the claims and the attached drawings.

DESCRIPTION OF THE PREFERRED EMBODIMENT

Figure 1:
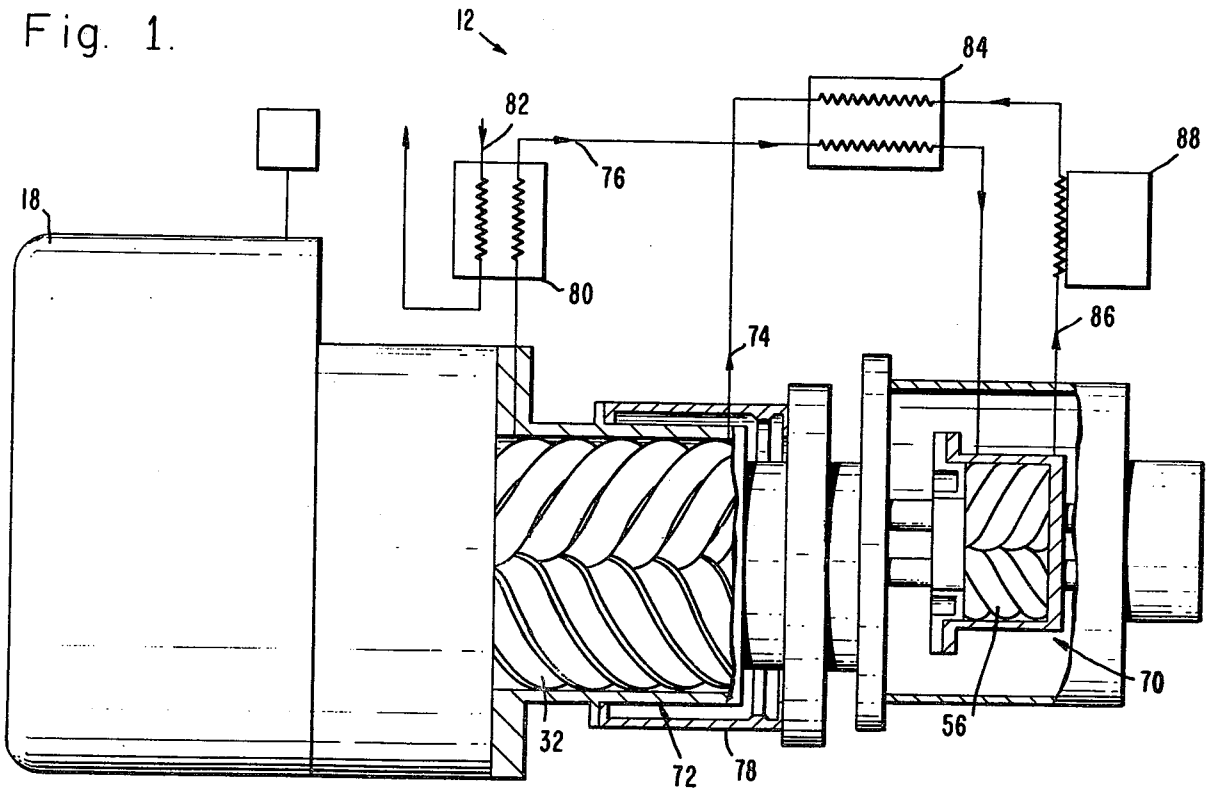
FIG. 1 is a side elevational view of the screw compressor-expander cryogenic system of this invention with parts broken away and parts taken in section to show the cryogenic gas flow path through the compression and the expansion chambers and through the heat exchangers.
Figure 2:
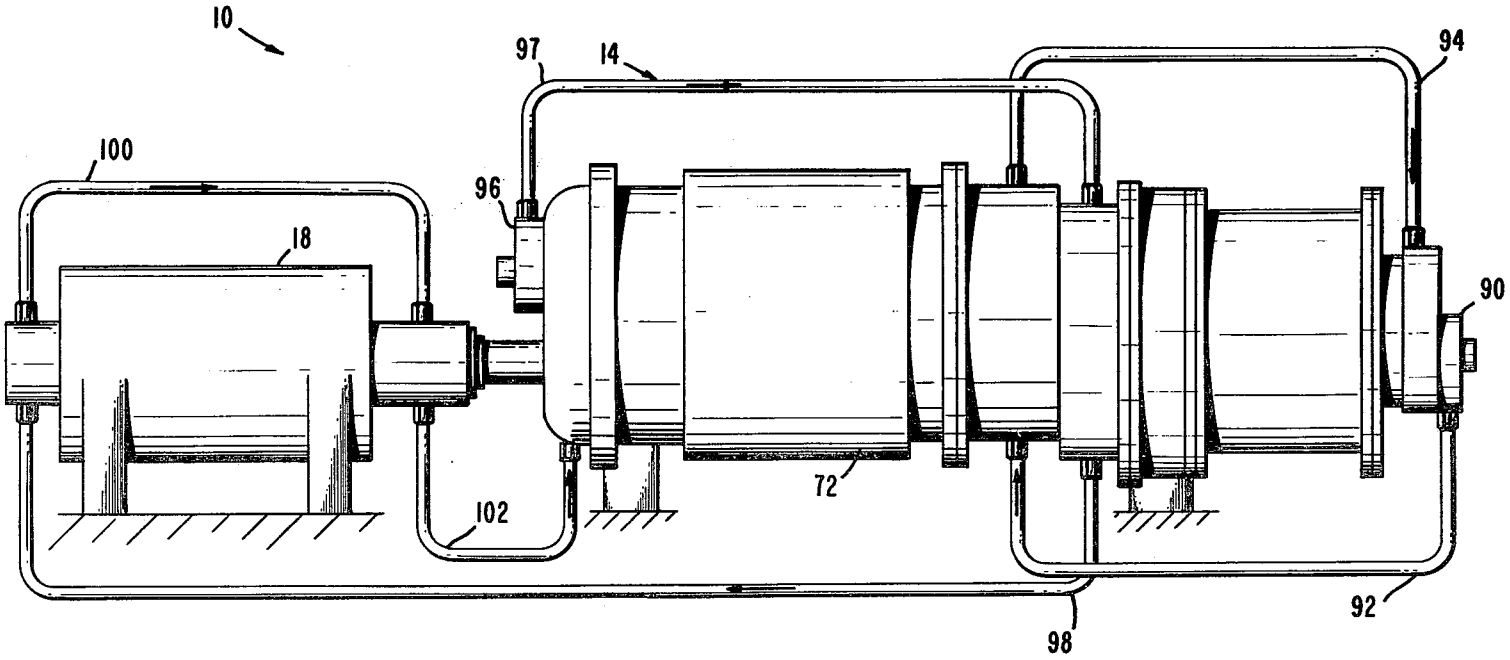
FIG. 2 is a side elevational view of a similar screw compressor-expander cryogenic system showing the machinery as interconnected by a lubrication system.
Figure 3:
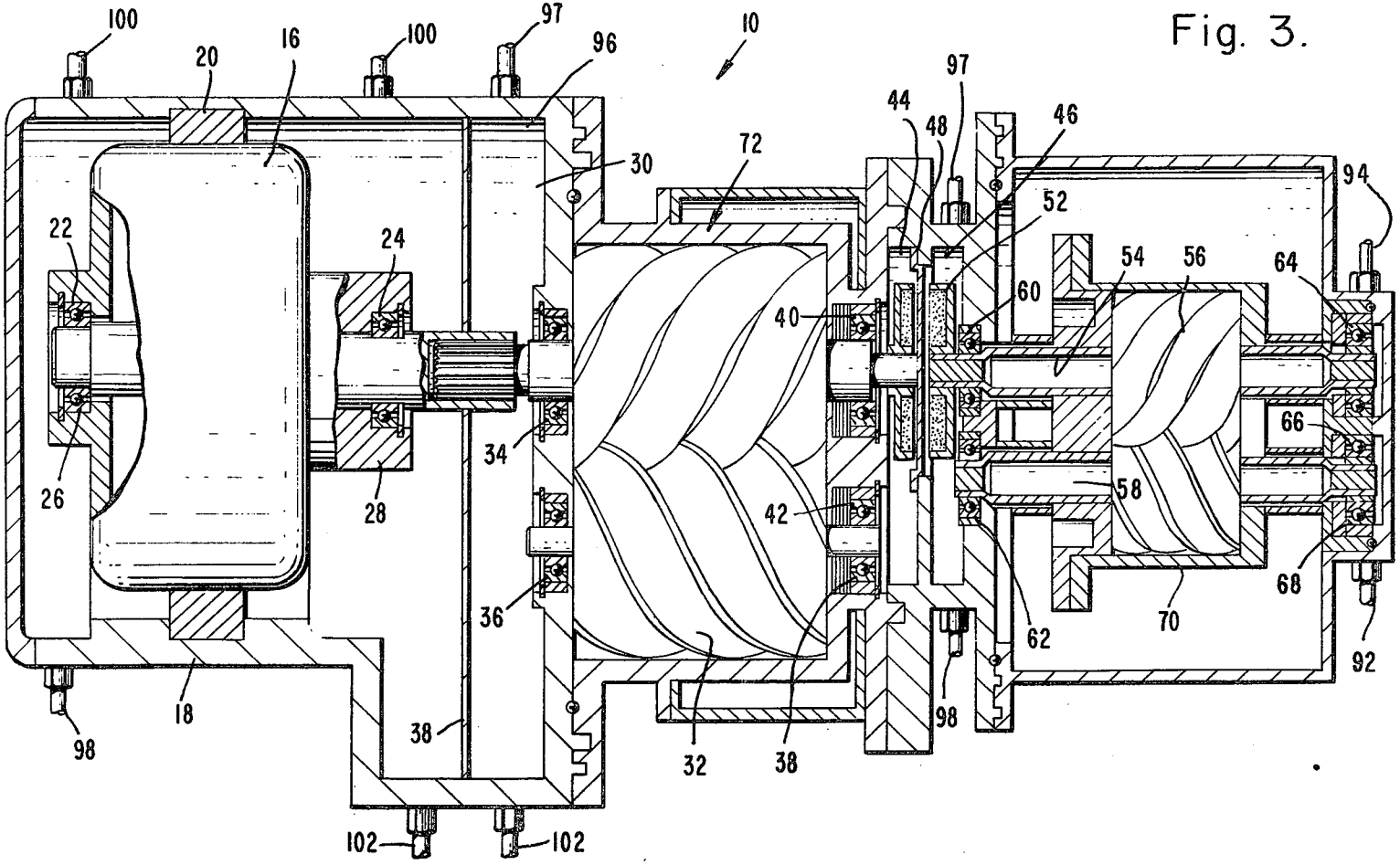
FIG. 3 is a longitudinal section taken through the center line of a screw compressor-expander cryogenic system showing the details of the compression and the expansion chambers, the magnetic coupling transmitting power and speed control between the compressor and the expander rotors and the lubrication of the various bearings.

The mechanical equipment 10 of the screw compressor-expander cryogenic system is generally indicated in FIGS. 1, 2, and 3. In FIG. 1 it is shown in association with the external gas flow equipment 12 which completes the cryogenic system and in FIG. 2 it is shown in association with the lubrication plumbing 14 which is external to the machinery 10. The machinery 10 comprises drive motor 16 which is usually an electric motor and is positioned within motor housing 18. Motor housing 18 is divided by wall 20 so that the motor bearings 22 and 24 in bearing bosses 26 and 28 are in separate lubrication compartments.

End wall 30 serves as the end wall for compressor chamber 32 as well as a mounting boss for the compressor drive end bearings 34 and 36. Wall 38 through motor housing 18 separates the compressor drive end bearings 34 and 36 from motor drive end bearing 24 to provide separate compartments for these bearings.

The other end of compressor chamber 32 is closed by end wall 38 which carries back end compressor bearings 40 and 42. Magnetic coupling compartment 44 is separated from magnetic coupling compartment 46 by thin magnetic wall 48. Magnetic coupling disc 50 is mounted on the end of the compressor shaft to rotate therewith.

As it is seen in FIG. 3, the compressor shaft is coupled to the motor shaft so that the whole structure is driven by the motor. Magnetic coupling disc 52 faces disc 50 from compartment 46 so that magnetic coupling between the discs takes place through wall 48. Each of the discs is a multiple magnet arranged so that the magnets can couple together to transmit torque Disc 52 is mounted on expander shaft 54 which extends out of expander compartment 56 on low thermal loss hollow shafts. The companion expander shaft 58 carries the mating expander rotor. The expander shafts are carried on bearings 60 and 62 in compartment 48 while the bearings 64 and 66 carry the other ends of the expander shafts in compartment 68. Each of the bearings is provided with a seal between the bearing and the adjacent compressor or expander chamber.

The rotors are designed such that the gas dynamics in the space between the rotors holds them apart so that no timing gears are necessary to prevent mechanical contact between the rotors. By appropriate rotor design, an expander 70 expanding air from one atmosphere to 0.5 atmosphere while running at 10,000 rpm can operate without contact. In a test of that nature, the rotors were inspected after a one hour test and showed no contact or wear.

As seen in FIG. 1, compressor 72 receives refrigerant gas at its right end through suction line 74 and compresses it within chamber 32 to deliver it in pressure line 76. As indicated above, suitable pressures are respectively 0.5 atmospheres in the suction line 74 and one atmosphere in the pressure line 76. Suitable refrigerant gases depend on the desired temperature, but include nitrogen, argon, carbon dioxide, neon, helium and hydrogen. The gas selected and the line pressures depend on the desired end temperature. Jacket 78 carries a coolant which carries off some of the heat of compression while after cooler 80 brings the refrigerant fluid in the pressure line 76 almost down to the temperature of the coolant in coolant line 82. Counterflow heat exchanger 84 further cools the gas flowing in pressure line 76. From heat exchanger 84, the gas in pressure line 76 goes into the expander chamber 56 at the left end which is the high pressure end of expander 70. Rotation of the rotors in the expander chamber expand the gas into cold line 86 which is at the pressure of suction line 74. Heat load 88 adds heat to the gas while the heat load 88 is cooled. From the heat load 88 the gas passes through counter flow heat exchanger 84 and back to the suction line 74 of compressor 72. The refrigeration cycle is discussed in more detail in patent application Ser. No. 894,677, filed Apr. 10, 1978, now abandoned. A continuation thereof was filed on June 12, 1980 and received Ser. No. 158,764, the entire disclosure which is incorporated herein by this reference.

One of the specific improvements is the fact that there is a wall 48 between the compressor and expander, with power transferred between the compressor and expander through the magnetic coupling. Because of the partition wall and the magnetic coupling there is no flow of gas between the compressor housing and the expander housing and thus the pressure in the adjacent bearing compartment is equal to the adjacent gas pressure in the chamber in the housing. In other words, there is no pressure drop which would drive lubricant from the bearing into the compressor or expander chamber or which would drive refrigerant gas into the bearing to drive lubricant out of the bearings.

In order to aid in bearing lubrication oil mist lubrication is provided. Radial blower 90, see FIG. 2 draws gas from compartment 68 together with the oil suspended in the gas and discharges it out line 92 where it is passed to compartment 44, see FIG. 3. From the top of compartment 44, line 94, carries the oil mist suspended in refrigerant gas back through compartment 68 to blower 90. When there is an oil mist of 1 to 5% per volume of bearing lubrication oil to refrigerant gas, the blower 90 maintains the oil in mist suspension as it passes through the lines and bearing compartments so that the bearings are continuously lubricated. The bearings 40, 42, 64 and 66 are lubricated by this circuit. From FIG. 1, it can be seen that the ends of the corresponding compressor and expander chambers adjacent these bearings are at the same pressure, the pressure of low-pressure line 76 so that there is no pressure drop between the bearing compartment and the chambers so that the oil is not driven one way or another.

Lubricant blower 96 is driven by the idler rotor in compressor 72. It draws refrigerant gas and suspended oil mist from the compartment of bearings 34 and 36 and delivers it through line 97 to compartment 46 where it serves to lubricate bearings 60 and 62. From that compartment, the mist is conveyed through line 98 to lubricate the bearing 22 and thence through line 100 to lubricate the other motor bearing 24. From thence, line 102 conveys the mist back to the compartment adjacent bearings 34 and 36 from whence it is drawn back into the blower 96 to continue its continuous closed cycle. The continuous closed cycle from blower 96 distributes lubricant through bearing compartments which are the same pressure as the adjacent gas, in this case 1 atmosphere, so there is no differential pressure across the bearings from adjacent compartments. This reduces load on the bearing seals.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A closed cycle refrigeration system comprising:

a screw compressor having a housing having a chamber therein, an inlet and an outlet in said housing and in communication with said chamber, first and second compressor rotors rotatably mounted on bearings, said rotors being within said compressor chamber in said compressor housing, said first and second rotors respectively having intermeshing lobes and recesses and configured so that compression occurs in gas passing through said compressor;

an expander having an expander housing, an expander chamber within said housing, an inlet and outlet on said expander housing, first and second expander rotors rotatably mounted on bearings and positioned within said expander chamber and said expander housing, said first and second rotors having intermeshing lobes and recesses so that gas expansion takes place in gas passing through said expander upon rotation of said expander rotors in said expander housing;

means interconnecting said inlet and said outlet on said compressor housing and said inlet and said outlet on said expander housing for providing a closed system for the circulation of refrigerant gas therein, for rejecting heat and for receiving heat for producing refrigeration upon rotation of said rotors; and at least one closed lubricant circulation loop separate from said refrigerant gas closed system connected to deliver lubricant past some of said bearings, said lubricant loop having a blower therein for circulating an oil mist and gas lubrication fluid to said bearings connected to said loop.

2. The closed cycle refrigeration system of claim 1 wherein one of said ends of said compressor is at a first pressure and the other end of said compressor is at a second pressure, and one of said ends of said expander is substantially at the first pressure and the other end of said expander is substantially at the second pressure and said lubrication loop is connected to said bearings adjacent the end of said chambers at said first pressure.

3. A closed cycle refrigeration system comprising:

a screw compressor having a housing having a chamber therein, an inlet and an outlet in said housing and in communication with said chamber, first and second compressor rotors rotatably mounted on bearings, said rotors being within said compressor chamber in said compressor housing, said first and second rotors respectively having intermeshing lobes and recesses and configured so that compression occurs in gas passing through said compressor;

an expander having an expander housing, an expander chamber within said housing, an inlet and outlet on said expander housing, first and second expander rotors rotatably mounted on bearings and positioned within said expander chamber and said expander housing, said first and second rotors having intermeshing lobes and recesses so that gas expansion takes place in gas passing through said said expander upon rotation of said expander rotors in said expander housing;

means interconnecting said inlet and said outlet on said compressor housing and said inlet and said outlet on said expander housing for providing a closed system for the circulation of refrigerant gas therein, for rejecting heat and for receiving heat for producing refrigeration upon rotation of said rotors, one of said ends of said compressor being at a first pressure and the other end of said compressor being at a second pressure, one of said ends of said expander being substantially at the first pressure and the other end of said expander being substantially at the second pressure; and a first lubrication loop connected to said bearings adjacent the end of said chambers at the first pressure to deliver lubricant past said bearings, said first lubrication loop having a blower therein for circulating an oil mist and gas lubrication fluid to said bearings connected to said first loop and a second lubrication loop connected to said bearings on the ends of said chambers substantially at the second pressure for circulating an oil mist an gas lubrication fluid to said bearings adjacent the end of said chambers at the second pressure so that the pressure in the lubrication loops is substantially the same as the pressure in the adjacent portions of each chamber to inhibit refrigerant gas flow into said bearings and to inhibit flow of lubrication fluid into said chambers.

4. The closed cycle refrigeration system of claim 3 wherein there there is a motor connected to drive said compressor, said motor having bearings, one of said lubrication loops being connected to said motor bearings to lubricate said motor bearings.

5. A closed cycle refrigeration system comprising:

a screw compressor having a housing having a chamber therein, an inlet and an outlet in said housing and in communication with said chamber, first and second compressor rotors rotatably mounted on bearings, said rotors being within said compressor chamber in said compressor housing, said first and second rotors respectively having intermeshing lobes and recesses and configured so that compression occurs in gas passing through said compressor;

an expander having an expander housing, an expander chamber within said housing, an inlet and outlet on said expander housing, first and second expander rotors rotatably mounted on bearings and positioned within said expander chamber and said expander housing, said first and second rotors having intermeshing lobes and recesses so that gas expansion takes place in gas passing through said expander upon rotation of said expander rotors in said expander housing;

means interconnecting said inlet and said outlet on said compressor housing and said inlet and said outlet on said expander housing from providing a closed system for the circulation of refrigerant gas therein, for rejecting heat and for receiving heat for producing refrigeration upon rotation of said rotors, one of said ends of said compressor being at a first pressure and the other end of said compressor being at a second pressure, one of said ends of said expander being substantially at the first pressure and the other end of said expander being substantially at the second pressure; and a first lubrication loop connected to said bearings adjacent the end of said chambers at the first pressure to deliver lubricant past said bearings, said first lubrication loop having a blower therein for circulating an oil mist and gas lubrication fluid to said bearings connected to said first loop and a second lubrication loop connected to said bearings on the ends of said chambers substantially at the second pressure, and a lubricant blower in said second lubricant loop for circulating an oil mist an gas lubrication fluid to said bearings adjacent the end of said chambers at the second pressure so that the pressure in the lubrication loops is substantially the same as the pressure in the adjacent portions of each chamber to inhibit refrigerant gas flow into said bearings and to inhibit flow of lubrication fluid into said chambers.

6. A closed cycle refrigeration system comprising:

a screw compressor having a housing having a chamber therein, an inlet and an outlet in said housing and in communication with said chamber, first and second compressor rotors rotatably mounted on bearings, said rotors being within said compressor chamber in said compressor housing, said first and second rotors respectively having intermeshing lobes and recesses and configured so that compression occurs in gas passing through said compressor;

an expander having an expander housing, an expander chamber within said housing, an inlet and outlet on said expander housing, first and second expander rotors rotatably mounted on bearings and positioned within said expander chamber and said expander housing, said first and second rotors having intermeshing lobes and recesses so that gas expansion takes place in gas passing through said expander upon rotation of said expander rotors in said expander housing;

means interconnecting said inlet and said outlet on said compressor housing and said inlet and said outlet on said expander housing for providing a closed system for the circulation of refrigerant gas therein, for rejecting heat and for receiving heat for producing refrigeration upon rotation of said rotors, one of said ends of said compressor being at a first pressure and the other end of said compressor being at a second pressure, one of said ends of said expander being substantially at the first pressure and the other end of said expander being substantially at the second pressure;

a first lubrication loop connected to said bearings adjacent the end of said chambers at the first pressure to deliver lubricant past said bearings, said first lubrication loop having a blower therein for circulating an oil mist and gas lubrication fluid to said bearings connected to said first loop and a second lubrication loop connected to said bearings on the ends of said chambers substantially at the second pressure, a lubricant blower in said second loop for circulating an oil mist an gas lubrication fluid to said bearings adjacent the end of said chambers at the second pressure so that the pressure in the lubrication loops is substantially the same as the pressure in the adjacent portions of each chamber to inhibit refrigerant gas flow into said bearings and to inhibit flow of lubrication fluid into said chambers; and a motor connected to drive said compressor, said motor having bearings and said bearings being connected to one of said lubricant fluid loops to be lubricated thereby.

* * * * *